United States Patent [19]

Schwemmer et al.

[11] 3,973,338

[45] Aug. 10, 1976

[54] SPIKE HEEL PLATE

[75] Inventors: Ronald Schwemmer; William Crozier, both of Santa Maria, Calif.

[73] Assignee: Lawrence Peska Associates, Inc., New York, N.Y. ; a part interest

[22] Filed: Jan. 26, 1976

[21] Appl. No.: 652,202

[52] U.S. Cl. ..... 36/65
[51] Int. Cl.[2] ..... A43C 15/00
[58] Field of Search ..... 36/62, 64, 65

[56] References Cited

UNITED STATES PATENTS

| | | | |
|---|---|---|---|
| 1,031,426 | 7/1912 | Czel | 36/65 |
| 1,349,542 | 8/1920 | Yanik | 36/64 |
| 2,026,013 | 12/1935 | Arieti | 36/62 |

*Primary Examiner*—Patrick D. Lawson

[57] ABSTRACT

A metal heel cap containing a plurality of downward pointing spikes enables walking on surfaces which are slippery due to coating of ice or moss. A plurality of thumbscrews are used to secure a pair of heel caps to the heels of the wearers shos when slippery footing is encountered. The heel caps are removed when non-slippery footing is reached.

2 Claims, 2 Drawing Figures

SPIKE HEEL PLATE

BACKGROUND OF THE INVENTION

The problem of enabling safe footing on slippery surfaces has engaged the attention of numerous prior inventors. Most prior inventors have used metal spikes protruding downward, using various kinds of attachment devices. Most of the devices in the prior art were devised in the age of laminated leather heels. Some, such as those shown in U.S. Pat. Nos. 628,263 and 2,034,050 required permanent attachment of appendages to the heels of the shoes or boots to enable installation; others, such as those shown in U.S. Pat. Nos. 628,263; 946,543 and 344,666 utilized clamps or straps completely or partially encircling the heel; and still others, such as U.S. Pat. Nos. 761,915 and 2,499,516 provided attachment across the instep. Finally, U.S. Pat. Nos. 607,686 and 908,040 show clamps combined with screw-type attachment to the wearer's heel.

None of the prior art shows a simple, light-weight method of attachment to modern heels of synthetic material.

SUMMARY OF THE INVENTION

The present invention discloses a light-weight heel cap containing downward-pointing spikes to enable safe footing on slippery surfaces. The heel cap is retained in place on the heel of the wearer's shoe or boot using a three-point suspension of penetrating thumbscrews combined with a front clamp.

DETAILED DESCRIPTION OF THE PREFERRED EMBODIMENT

Figure 1:
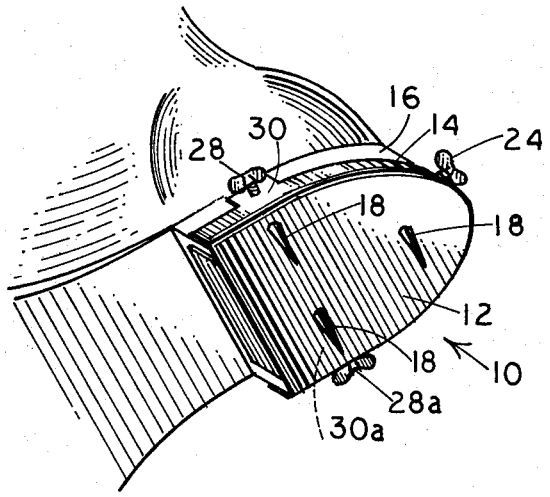
FIG. 1 shows a three-quarter view of a spike heel plate installed on the heel of a shoe or boot.

Referring specifically to FIG. 1, there is shown a spiked heel plate shown generally at 10. The heel plate 10 is comprised of a bottom plate 12 and a rim 14. The bottom plate 12 covers the bottom surface of the heel 16. A plurality of spikes 18 protrude downward from the bottom plate 12.

Figure 2:
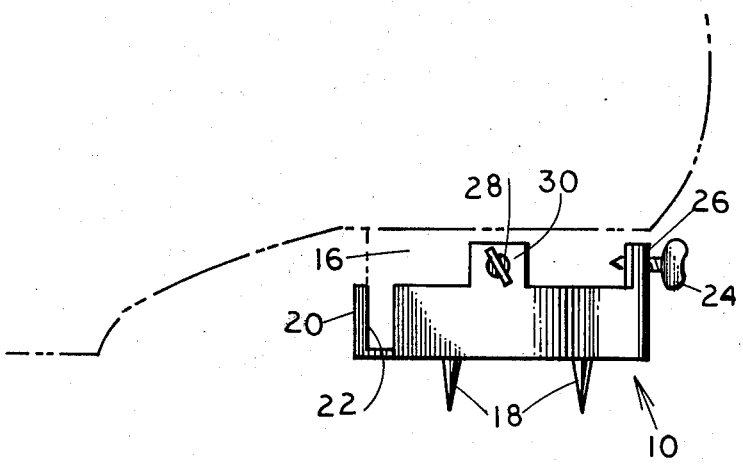
FIG. 2 shows a side view of the spike heel plate showing details of the attachment to the heel.

Referring now to FIG. 2, a lip 20 at the front of the heel plate 10 bears against the front surface 22 of the heel. A rear thumbscrew 24 installed in cooperative threads of a rear tab 26 attached to the lip 14 partially penetrates the heel 16 and draws the lip 20 into intimate contact with the front surface 22 of the heel 16. Two side thumbscrews **28, 28*a* installed in cooperating threads of side tabs 30, 30*a* partially penetrate the sides of the heel 16. The three-point suspension combination of rear thumbscrew 24 with side thumbscrews 28 and 28*a* support the spike heel plate 10 on the heel 16**.

To install the spiked heel plate 10, the wearer first places it in place on the heel 16 and tightens the rear thumbscrew 24. Then he tightens the two side thumbscrews **28, 28*a* approximately equal amounts. When safe footing is reached, the spiked heel plate 10** is removed by following a removal procedure which is the inverse of the installation procedure.

What is claimed is:

1. A spike heel plate comprising:

a bottom plate;

a rim on said bottom plate adapted to encircle the sides and rear of the heel of a boot or shoe;

a plurality of spikes protruding downward from said bottom plate;

a rear tab containing a threaded hole at the rear of said rim extending upward from the rear of said rim;

a rear thumb screw engaged in the cooperating threads of said rear tab;

two side tabs, each containing a threaded holed, at the sides of said rim extending upward from the sides of said rim;

two thumbscrews engaged in the cooperating threads of said two side tabs; and a front lip on said bottom plate adapted to bear on the front of said heel of the boot or shoe.

2. The spike heel plate recited in claim 1, wherein the number of spikes in each heel plate is three.

* * * * *